United States Patent [19]

Lumpp

[11] 4,177,933

[45] Dec. 11, 1979

[54] CONTAINER AND CLOSURE THEREFORE

[75] Inventor: Günter Lumpp, Reutlingen, Fed. Rep. of Germany

[73] Assignee: Rieber Werke Heinrich Rieber KG, Reutlingen, Fed. Rep. of Germany

[21] Appl. No.: 944,377

[22] Filed: Sep. 21, 1978

[30] Foreign Application Priority Data

Oct. 14, 1977 [DE] Fed. Rep. of Germany ... 7731724[U]

[51] Int. Cl.[2] ..... B65D 39/00

[52] U.S. Cl. ..... 220/307

[58] Field of Search ..... 220/260, 307, 367, 270

[56] References Cited

U.S. PATENT DOCUMENTS 3,184,096 5/1965 Cheely ..... 220/260

3,289,881 12/1966 Ganung ..... 220/307

*Primary Examiner*—George T. Hall

*Attorney, Agent, or Firm*—Michael J. Striker

[57] ABSTRACT

A container includes a container body provided with a neck portion forming a circumferential opening, a removable lid operative for firmly closing the opening. The lid includes a cap body, an outer elastomeric rim circumferentially and outwardly projecting from the cap body. The rim comprises a lower annular portion operative to firmly engage the inner wall of the neck portion when the latter is in assembly with the lid, and an upper portion so spaced from the lower portion as to engage the outer upper surface of the neck portion when the lower portion is inserted all the way in the opening.

9 Claims, 1 Drawing Figure

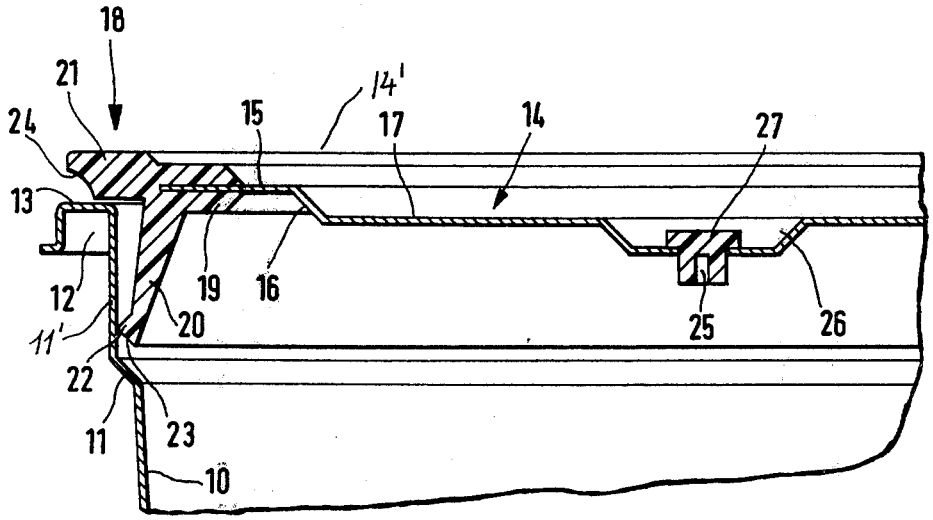
18
21
24
13
12
11'
22
11
23
10
20
19
16
15
14'
17
14
27
25
26

CONTAINER AND CLOSURE THEREFORE

BACKGROUND OF THE INVENTION

The present invention relates to containers. More particularly, this invention concerns containers with removable lids.

It is known in the prior art to provide a container with a removable lid having at least one air opening (see German Auslegungsschrift 2007301). Usually such a lid is made of elastomeric material. The lid is designed to firmly close the opening of the container and simultaneously hold on the container in such a firm position during transporting or storing of such containers.

It has been recognized that the known lids are not satisfactory with respect to the requirements made as to durability and reliability of the lids when in assembly with the container.

SUMMARY OF THE INVENTION

It is a general object of the present invention to avoid the disadvantages of the prior art containers.

More particularly, it is an object of the present invention to provide a container with such a lid which can be used in a durable and reliable manner without an undesired additional removable space-consuming locking member.

Another object of the present invention resides in providing a lid which ensures absolute sealing and closing of containers, even if they are stacked one on the other. In other words, one of the objects of the present invention is to exclude any possible damage of the seal closing the containers.

In pursuance of these objects and others which will become apparent hereafter, one feature of the present invention resides in providing a container having a container body provided with a neck portion forming a circumferential opening with a removable lid operative for firmly closing the opening. The lid comprises a cap body adapted to substantially cover the opening of the container when the latter is in assembly with the lid, an outer elastomeric rim circumferentially and outwardly projecting from the cap body. The rim includes a lower annular portion adapted to firmly engage the inner wall of the neck portion of the container when the latter is in assembly with the lid and an upper portion so spaced from said lower portion as to engage the outer upper surface of the neck portion when said lower portion is inserted all the way in the opening thus preventing further penetration of the lid inside the opening of the container and ensuring firm closing of the container.

The elastomeric rim is vulcanized directly on the cap body of the lid, to thereby ensure reliably rigid connection between the rim and the cap body.

Besides the fact that vulcanization of the rim on the cap body is a rather simple technique, it ensures that such a connection can reliably resist relatively big loads on the lid.

The upper portion of the rim is provided at the inner side thereof with a shoulder which together with the upper outer surface of the neck defines an unobstructed space. Thus, the shoulder can be used to grip the lid when it is desired for example to withdraw the latter from the opening of the container.

Such a construction renders it possible to remove any undesired dirt accumulation in this space before the lid is withdrawn from the neck opening.

It is also to be mentioned, that such a shape of the lid alleviates the manufacture of the lids.

The lower portion of the elastomeric rim extends substantially normal to the generally horizontal plane of the cap body. The lower end of the lower portion is provided with a bulge extending outwardly and provided with an inclined surface. This bulge is designed to engage the inner wall of the neck opening. It is to be mentioned that the bulge enhances the stoutness of the lower portion in comparison with that of the above-mentioned prior art reference.

The lower portion has a conical cross-section, namely it converges downwardly, and is provided at its free end with the bulge which guarantees an absolutely reliable sealing connection of relatively considerable rigidity and consequently a large stressing force between the bulge and the corresponding inner wall of the neck opening. The bulge has such dimensions as to be accommodated to the shape of the inner wall of the neck opening of the container.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

The single FIGURE shows a schematic cross-sectional view of a portion of a container with a lid in accordance with the present invention.

DESCRIPTION OF THE PREFERRED EMBODIMENTS

Referring now to the FIGURE it may be seen that the reference numeral 10 designates a side wall of an elongated container——shown only partially. The vertical side wall 10 has an upper enlarged vertical portion 11' which is separated from the remaining portion of the wall 10 by a shoulder 11. The upper portion 11' is provided with a twice-outwardly-folded part forming a groove 12 open downwardly and defined from thereabove by a horizontal flange 13.

A lid for closing the opening of the container is designated in toto by the reference numeral 14'. The lid 14 includes a central substantially horizontal member 14. The member 14 is provided with a horizontal annular portion 15, a downwardly inclined step portion 16 and another horizontal portion 17. The step portion 16 serves as a side stop for the corresponding portion of another container when the latter is stacked on the horizontal portion 17 of the first container.

The portion 15 of the member 14 is closely received in a groove of a rim 18 which circumferentially embraces the member 14. The rim 18 is of elastomeric material such as natural synthetic rubber, or synthetic plastic material.

In accordance with the present invention the rim 18 is vulcanized directly on the member 14, so as to ensure the reliably rigid connection between each other. The rim 18 includes three differently shaped portions, namely a holding portion 19, a sealing portion 20 and a gripping portion 21. The groove for receiving the horizontal portion 15 of the member 14 is provided on the holding portion 19 of the rim 18.

The sealing portion 20 extends downwardly and substantially normal relative to the general horizontal plane of the lid 14'. The portion 20 has a conical downwardly converging profile. At the lower end thereof the portion 20 is provided with an outwardly directed sealing lip section or bulge 22. The bulge 22 has an inwardly inclined surface 23. The inclination of the surface 23 corresponds to the inclination of the shoulder 11 of the container wall 10. The bulge 22 of the portion 20 engages the portion 11' of the container wall 10 when the lid 14' closes the opening of the container. When the lid 14' is inserted in the opening of the container the surface of the portion 20 slides along the inner wall of the portion 11' until it abuts the shoulder 11. The portion 20 is so dimensioned that before being inserted in the corresponding opening it has to be bent inside and downwardly so as to be accommodated within the opening. Due to the elasticity of the rim 18, and the portion 20 in particular, the bulge 22 is urged permanently outwardly, that is against the wall of the portion 11' from inside thereof, thus ensuring a reliable sealing closure of the opening.

The gripping portion 21 is provided on its lower side with a shoulder 24. Thus, the portion 21 abuts the horizontal flange 13 only with the respective part of the lower side of the portion 21. The space defined between the shoulder 24 and the outer surface of the flange 13 is designed to render it possible to grip the lid 14' when it is desired, for example, to withdraw the lid 14' from the opening of the container.

The lid 14' is provided with an air outlet 25, which may be provided, for example, in a recess 26 formed on the horizontal portion 17 of the member 15'. The outlet 25 may be closed by a plug 27 made of plastic synthetic material.

It is to be understood that the container in accordance with the present invention may have different shapes.

Should the container be used strictly in a vertical position, that is avoiding any inclination thereof, then instead of providing the closeable air outlet of the type used in the preferred embodiment there may be provided small air openings in the horizontal portion 15 of the member 14.

It will be understood that each of the elements described above, or two or more together, may also find a useful application in other types of containers differing from the types described above.

While the invention has been illustrated and described as embodied in a container, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, farily constitute essential characteristics of the generic or specific aspects of this invention.

What is claimed as new and desired to be protected by Letters Patent is set forth in the appended claims.

1. A container, comprising a container body provided with a neck portion forming an opening; and a removable lid operative for firmly closing said opening and including a cap body adapted to substantially cover said opening of the container when the latter is in assembly with the lid, an outer elastomeric rim circumferentially and outwardly projecting from said cap body and comprising a lower annular portion extending substantially normal to the elongation of said cap body and adapted to firmly engage the inner wall of the neck portion of the container when the latter is in assembly with the lid, said lower portion being provided with a free end opposite said cap body and having a bulge extending outwardly from said free end and formed with an inclined surface, said rim further comprising an upper portion so spaced from said lower portion as to engage the outer upper surface of the neck portion when said lower portion is inserted all the way in said opening, thus preventing further penetration of the lid inside the opening of the container and ensuring firm closing of the container, said upper portion of the rim being provided on an inner side thereof with a shoulder part defining a space between the upper outer surface of said neck portion and the inner side of said shoulder part, so as to define a gripping surface on said upper portion operative to be gripped when said lid is to be withdrawn from said opening.

2. A container, comprising a container body provided with a neck portion forming an opening; and a removable lid operative for firmly closing said opening and including a cap body adapted to substantially cover said opening of the container when the latter is in assembly with the lid, an outer elastomeric rim circumferentially and outwardly projecting from said cap body and comprising a lower annular portion adapted to firmly engage the inner wall of the neck portion of the container when the latter is in assembly with the lid, said lower portion being provided with a free end opposite said cap body and having a bulge extending outwardly from said free end and formed with an inclined surface, said rim further comprising an upper portion so spaced from said lower portion as to engage the outer upper surface of the neck portion when the said lower portion is inserted all the way in the opening, thus preventing further penetration of the lid inside the opening of the container and ensuring firm closing of the container.

3. A container as defined in claim 2, wherein said upper portion of the rim is provided on an axially inner side thereof with a shoulder part defining between the upper outer surface of said neck portion and the inner side of said shoulder part a groove to receive the fingers of a user when said lid is in assembly with the container body.

4. A container as defined in claim 2, wherein said lid is provided with at least one air outlet.

5. A container as defined in claim 4, wherein said outlet is permanently open.

6. A container as defined in claim 4, wherein said outlet is provided with a removable plug.

7. A container as defined in claim 2, wherein said rim is vulcanized directly on said cap body.

8. A container as defined in claim 2, wherein said lower portion has a conical cross-section converging downwardly from said cap body.

9. A container as defined in claim 7, wherein said rim is provided with a groove for circumferentially rigidly receiving therein a circumferential portion of said cap body.

* * * * *